US006321047B1

(12) United States Patent
Takata

(10) Patent No.: US 6,321,047 B1
(45) Date of Patent: Nov. 20, 2001

(54) IMAGE HEATING APPARATUS

(75) Inventor: Shinichi Takata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/648,734

(22) Filed: Aug. 28, 2000

(30) Foreign Application Priority Data

Aug. 31, 1999 (JP) ..... 11-245008

(51) Int. Cl.[7] ..... G03C 15/20
(52) U.S. Cl. ..... 399/69; 399/67
(58) Field of Search ..... 399/69, 67; 219/216

(56) References Cited

U.S. PATENT DOCUMENTS 5,464,964 * 11/1995 Okuda et al. ..... 219/216 X
5,656,187 8/1997 Miyamoto et al. ..... 219/216
5,842,079 11/1998 Miyamoto et al. ..... 399/33

FOREIGN PATENT DOCUMENTS 2-143277 * 6/1990 (JP) .

* cited by examiner

*Primary Examiner*—Quana M. Grainger
(74) *Attorney, Agent, or Firm*—Fitzpatrick, Cella, Harper & Scinto

(57) ABSTRACT

An image heating apparatus has a heating member for heating an image on a recording material, a backup member for forming a nip in cooperation with the heating member, and an electric power supply control device for controlling electric power supplied to the heating member so that the temperature of the heating member may be maintained at a set temperature. When the recording material is not in the nip as a plurality of recording materials are continuously heated, the electric power supply control device can select first control in which temperature control is effected so that the heating member may maintain the set temperature, and second control in which temperature control is not effected and the electric power supply to the heating member is not effected.

9 Claims, 5 Drawing Sheets

IMAGE HEATING APPARATUS

BACKGROUND OF THE INVENTION

1. Field of the Invention

This invention relates to an image heating apparatus typified by a fixing device used in an image forming apparatus such as a copier or a printer.

2. Related Background Art

Such a fixing device as is used in an image forming apparatus has a heating member for heating a recording material, a pressurizing member cooperating with the heating member to form a nip for nipping and conveying a recording material bearing an image thereon, and electrical energization controlling means for controlling the electrical energization of the heating member so that the heating member may maintain a set temperature, and heats the image by the thus temperature-controlled heating member to thereby secure good fixativeness of the image.

The heating member continues to be temperature-controlled when a plurality of recording materials are continuously heated as well as when a recording material is heated and therefore, during the time from after a recording material has passed through the nip until the next recording material enters the nip, the electrical energization of the heating member is effected to restore the temperature of the heating member which is reduced by the recording material taking away the heat quantity of the heating member, to a set temperature.

However, if the time from after a recording material has passed through the nip until the next recording material enters the nip is long, the temperature of the pressurizing member sometimes rises to a considerable temperature by the heat from the heating member of which temperature is continuously controlled during that time.

The inventor has found the phenomenon that if particularly the environment in which the apparatus is used is at a high temperature when the next recording material has entered the nip in a state in which the pressurizing member has thus risen in its temperature, the moisture contained in the recording material is evaporated by the heat of the heating member and adheres to the surface of the pressurizing member. The inventor also found the phenomenon that the recording material slips by the moisture adhering to the surface of this pressurizing member and the recording material fails to be normally conveyed and is jammed.

SUMMARY OF THE INVENTION

The present invention has been made in view of the above-noted problems and an object thereof is to provide an image heating apparatus in which the bad conveyance of recording materials can be prevented.

Another object of the present invention is to provide an image heating apparatus in which the excessive temperature rise of a backup member can be restrained.

Still another object of the present invention is to provide an image heating apparatus comprising:

- a heating member for heating an image on a recording material;
- a backup member for forming a nip in cooperation with the heating member; and
- electric power supply control means for controlling electric power supplied to the heating member so that the temperature of the heating member may be maintained at a set temperature;

- wherein when the recording material is not nipped by the nip in case that a plurality of recording materials are continuously heated, the electric power supply control means can select first control in which temperature control is effected so that the heating member may maintain the set temperature, and second control in which temperature control is not effected and the electric power supply to the heating member is not effected.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the accompanying drawings.

Such an image forming apparatus will first be described briefly.

Figure 1:
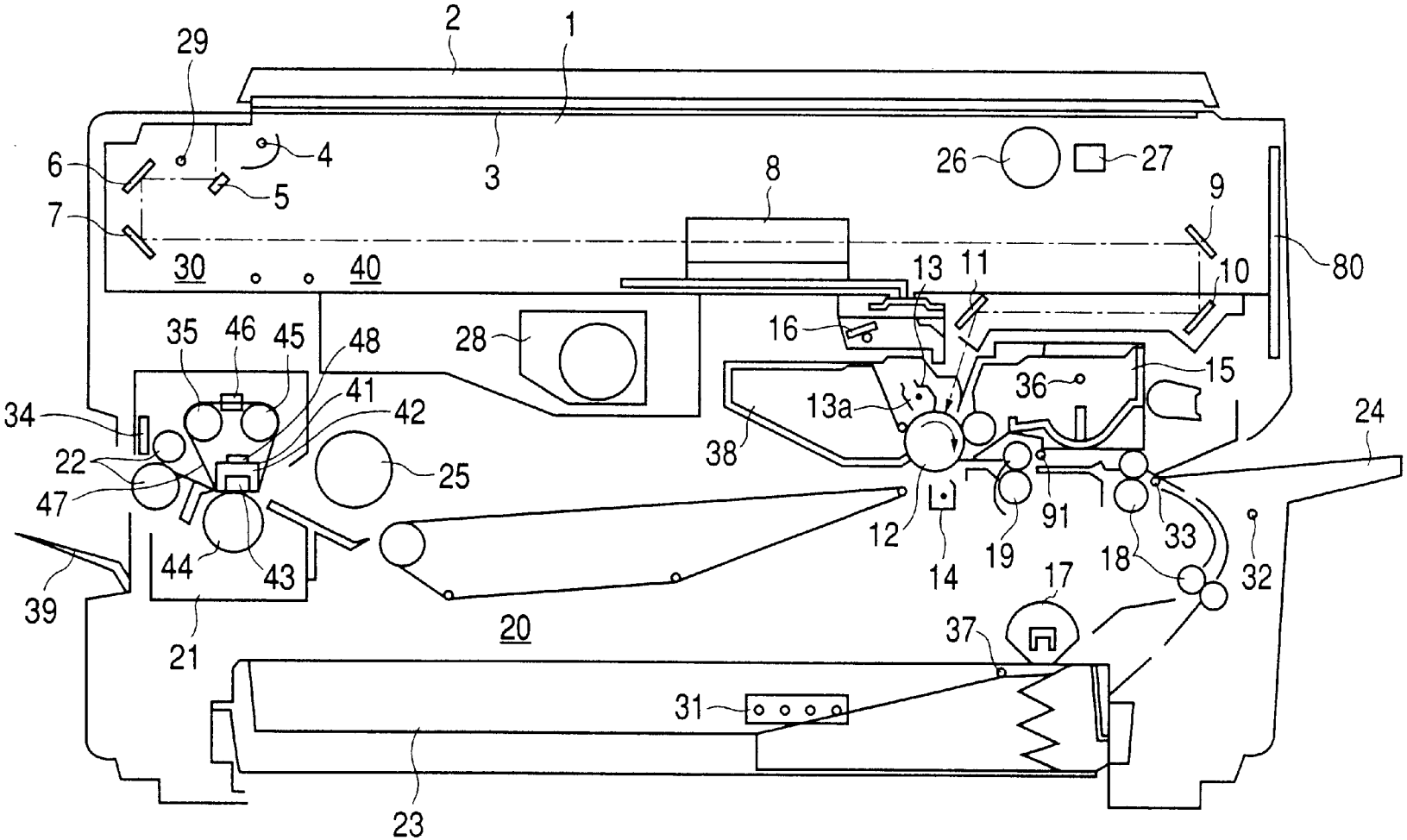
FIG. 1 is a cross-sectional view schematically showing the construction of an image forming apparatus according an embodiment of the present invention.

FIG. 1 is a cross-sectional view schematically showing the construction of an example of an image forming apparatus provided with an image heating apparatus according to an embodiment of the present invention.

In such an image forming apparatus, a photosensitive member 12 in an image forming portion is first rotated in a clockwise direction, as shown in FIG. 1, and the surface of the photosensitive member 12 is uniformly charged by primary charging means 13. On the surface of the photosensitive member 12 charged to predetermined potential by the primary charging means 13, a latent image conforming to image information from an original or the like is formed by an exposure lamp unit 4-11, whereafter the latent image is developed as a developer image by a developing unit 15. The developer image on the photosensitive member 12 is transferred to recording paper which is a recording material fed from a paper feeding portion such as a cassette 23, by a transferring unit portion 14. After the transfer, the photosensitive member 12 is repeatedly subjected to the process of removing any residual toner on the surface thereof by a cleaning unit 38, removing any residual potential on the surface thereof by a pre-exposure lamp 16, and using again for image formation. The recording paper to which the developer image has been transferred is sent to a fixing unit 21 while resting on the conveying belt of a conveying unit 20 which is conveying means.

The recording paper which has entered the fixing unit 21 is heated and pressurized by the nip of the fixing unit 21, whereby the developer image on the recording paper is fixed, and the recording paper is discharged from the fixing unit 21 by paper discharging rollers 22 and is contained onto a paper discharge tray 39. A paper discharge sensor 34 is a sensor for detecting whether the recording paper has been normally passed through the fixing unit 21 and discharged, and is adapted to count up a paper discharge counter in a microcomputer Q1 provided in a controller portion 80 when the recording paper has been normally passed.

The operation of such an image forming apparatus will now be described in detail.

In such an image forming apparatus, a power source cord (not shown) provided in the main body of the image forming apparatus is connected to a predetermined power source.

As shown in FIG. 1, a driving system in such an image forming apparatus is separated into a main driving system for driving a paper feeding portion, a conveying portion, the photosensitive member and a fixing portion, and an optical driving system for driving an optical system. In the present embodiment, a stepping motor 25 is adopted as the drive source of the main driving system, and a stepping motor 26 is adopted as the drive source of the optical driving system (including a mechanism for reading images). The drive sources are adapted to be drive-controlled by a controller portion 80 which is electric power supply control means. The controller portion 80 includes the microcomputer Q1, an enlarged IC portion, etc., and is provided with a whole driving circuit.

Figure 2:
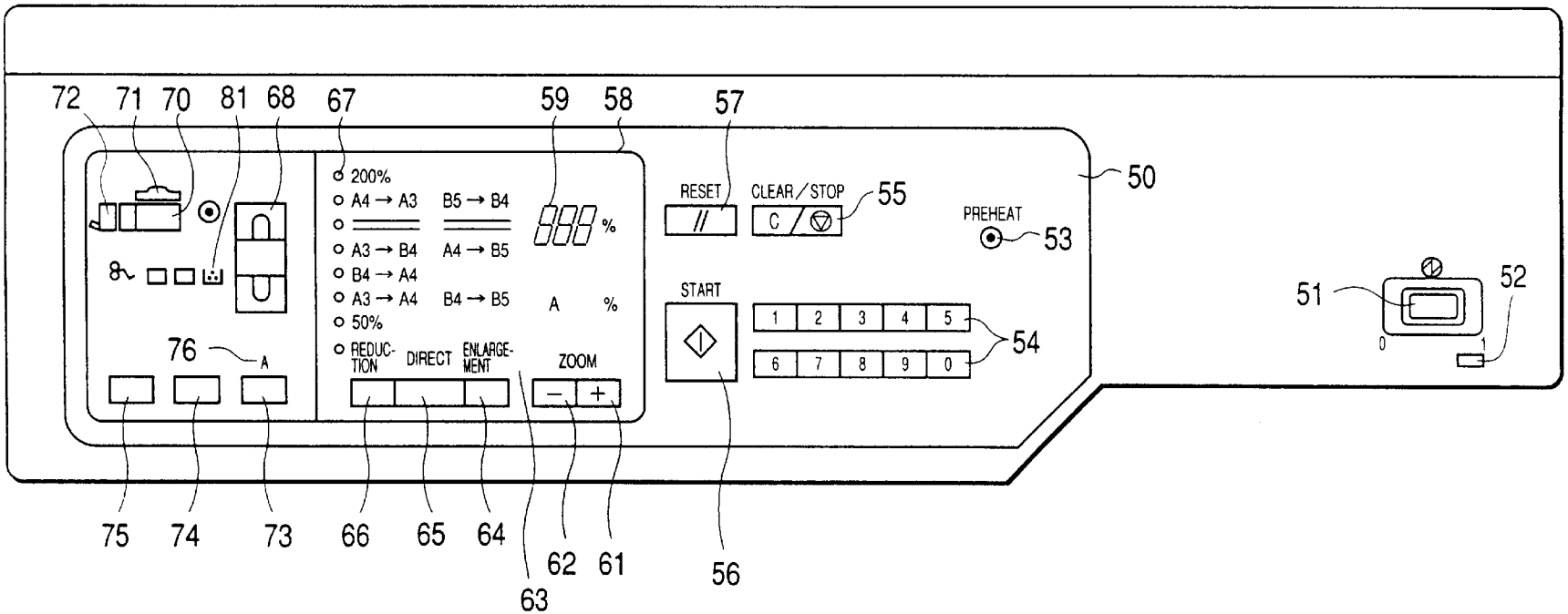
FIG. 2 is a front view of an operating panel provided on the main body of the image forming apparatus of FIG. 1.

FIG. 2 is a front view of an operating panel disposed on the upper surface of the image forming apparatus of FIG. 1.

Such an operating panel has a power source switch 51, and is designed such that when this switch is depressed, a power is supplied to the image forming apparatus and at the same time, a power source indicating lamp 52 is turned on and indicated.

Also, the indicating portion of such an operating panel is set such that when the power source switch is closed, as standard modes, a sheet number indicator 59 indicates 1, a magnification indicator 67 indicates one-to-one magnification, and the indication A (the abbreviation of Auto) of an automatic density adjustment indicator 76 is turned on.

Further, the indicating portion of the copy start key 56 of such an operating panel is adapted to be red indication during the initial setting (such as moving a lens to the one-to-one magnification position) when the power source switch is closed, and during copying, and indicate usually by green indication in which the copying operation is possible.

The operation of the optical driving system after the closing of the power source switch will now be described.

The image forming apparatus according to the present embodiment has the multi-stage magnification selecting function by the position control of a zoom lens unit 8 and the speed control of the exposure lamp unit 4-7 by the stepping motor 26 of the optical driving portion, the function of automatically effecting density selection by an optical sensor 40 for detecting the reflected light of an original placed on the surface of original supporting glass 3, the automatic selecting function for copying magnifications by the connection to an outside apparatus (not shown) by communication means, the memory backup function of storing various states, e.g. the number of remaining sheet, the magnification value, abnormal information, etc. when an abnormality such as paper jam has occurred, and further the continuous page copying function by controlling the position of the exposure lamp 4 by the stepping motor 26, and further the function capable of forming a plurality of color images by interchanging a developing unit 15, and changing over the control of this stage by providing a switch 36 for detecting the interchange of the developing unit 15.

The exposure lamp unit 4-7 scans the original on the original supporting glass 3 from the left end to the right as viewed in FIG. 1, and the exposure light from the exposure lamp 4 conforming to the image of the original is applied to the photosensitive member 12 through the intermediary of a first mirror 5, a second mirror 6, a third mirror 7, a zoom lens unit 8, a fourth mirror 9, a fifth mirror 10 and a sixth mirror 11. Thus, in the present embodiment, the starting point of the movement of the exposure lamp unit 4-7 is set at the left end in FIG. 1, and this position is defined as the home position (hereinafter referred to as HP). Also, in the present embodiment, an HP sensor 29 is provided to detect HP, and when during the closing of the power source switch, the HP sensor 29 does not detect the position of the exposure lamp 4, the control portion by the microcomputer Q1 is adapted to control the rotation of the stepping motor 26 and move the exposure lamp unit to the HP side.

When the exposure lamp unit 4-7 lies at HP, the stepping motor 26 moves the zoom lens unit 8. As described above, during the closing of the power source switch, the one-to-one magnification value is selected as the standard mode, and this position is defined as the zoom home position (hereinafter referred to as ZHP). In the present embodiment, a ZHP sensor 50 is provided to detect ZHP, and when during the closing of the power source switch, the ZHP sensor 50 does not detect the position of the zoom lens unit 8, the control portion by the microcomputer Q1 is adapted to control the rotation of the stepping motor 26 and move the zoom lens unit 8 to the ZHP side.

Thus, by the termination of the initial operation of the optical driving system, the preparation for the copying operation of the image forming apparatus is completed.

The operation of the cassette 23 after the closing of the power source switch will now be described.

In a paper feeding method in the image forming apparatus according to the present embodiment, the paper feeding from the cassette 23 and the paper feeding from a multi-manual feeding portion 24 can be selected. In the case of the paper feeding from the cassette 23, the state of the cassette 23 is controlled by a switch (not shown) for detecting the presence or absence of the cassette 23, a switch group 31 for detecting the size of the cassette 23, and a switch 37 for detecting the presence or absence of paper in the cassette 23, and when an abnormality is detected by the above-mentioned switches, it is adapted to be indicated on an indicating portion which will be described later. In the case of the manual feeding, the state of the multi-manual feeding portion 24 is adapted to be detected by a switch 33 for detecting the presence or absence of paper. When an abnormality is detected by the switch 33, it is adapted to be indicated on an indicating portion which will be described later. Also, it is possible to measure the length of passing paper by the switch 33 of the multi-manual feeding portion 24.

In such an image forming apparatus, when the copy start key 56 is depressed, the copying operation is started on the basis of the recording paper size data by the input signal of the switch group 31 for detecting the size of the cassette, the sheet number data set by copy quantity keys 54, the magnification data by magnification selecting keys 61, 62, 64, 65 and 66, and other data by various mode selecting means.

When the copy start key 56 is accepted, the indication on the operation panel of the image forming apparatus changes from green to red, and the mode changeover keys such as the copy quantity keys 54 and the magnification selecting keys 61, 62, 64, 65 and 66 are inhibited from being input. At this time, the stepping motor 25 which is a main driving motor starts to rotate, and a driving force starts to be transmitted to the paper feeding roller 18, the photosensitive member 12, the conveying unit 20, the paper discharging rollers 22, the fixing unit 21, etc.

After 0.5 sec. from the start of the rotation of the stepping motor 25, a paper feeding solenoid (not shown) is operated, and the paper feeding roller 17 is rotated therewith and feeds the recording paper in the cassette 23 toward paper feeding rollers 18. When the recording paper arrives at the paper feeding rollers 18, the recording paper is fed to registration rollers 19 by the paper feeding rollers 18 and is stopped at a point of time whereat it has arrived at the registration rollers. In the present embodiment, design is made such that a registration presensor 91 installed between the paper feeding rollers 18 and the registration rollers 19 detects the fed state of the recording paper between the paper feeding rollers 18 and the registration rollers 19 and also measures the length of the recording paper during the time when the registration rollers 19 convey the recording paper.

At predetermined timing until the recording paper is fed on a paper feeding path and arrives at the registration rollers 19, the start of the scanning of the original by the exposure lamp unit 4-7 is permitted. At this time, the exposure lamp 4 is in its position detected by the HP sensor 29. More particularly, the exposure lamp 4 is stopped at a position moved backward by a distance conforming to the selected magnification at that point of time from a position at which the HP sensor 29 has detected the exposure lamp 4 when the initial operation or during the backward movement of the copying operation is executed.

The pulse rate gradually increases until by the start of the scanning of the original, the stepping motor 26 which is the optical system driving source reaches a driving pulse rate conforming to the selected magnification value in a direction (rightward direction) in which the exposure lamp unit 4-7 is moved forward (hereinafter referred to as the slow up control). That is, the moving speed of the exposure lamp unit 4-7 is gradually accelerated and reaches a target speed.

As regards the scanning distance of the exposure lamp unit 4-7, movement by a predetermined distance is started in conformity with cassette size data and magnification data, etc., and at predetermined timing, the start of the conveyance of the recording paper by the registration rollers 19 is permitted, and the above-described image forming operation is started. The exposure lamp unit 4-7 gradually decreases the pulse rate at a point of time whereat it has arrived at a target position (hereinafter referred to as the slow down control) and is stopped, whereafter it is moved backward by the slow up control and the slow down control again toward the HP sensor 29. At a point of time whereat the HP sensor 29 has detected the exposure lamp 4, the slow down control for stopping the exposure lamp at a position conforming to the selected magnification is effected and the exposure lamp unit 47 is stopped.

The operation of the fixing unit 21 in the present embodiment will now be described in detail.

The present invention relates to the electric power supply control of the fixing heater of the fixing unit in the above-described image forming apparatus (particularly the control of the heater between fixed sheets).

The fixing unit 21 is provided with endless film 47, a pressurizing roller 44 which is a pressurizing member, and a heater 43 which is a heating member.

The heater 43 has a resistor printed on a ceramic substrate, and is supported by a heat-resisting plastic supporter 42, and further, a metallic stay is attached to and provides toughness to the plastic supporter 42.

The endless film 47 is rotatably supported by a driving roller 35, a tension roller 45 and the heater 43. A temperature detecting element (thermistor) 41 is attached to the metallic stay, and the temperature detecting element 41 is in direct contact with the back surface of the heater 43. In the present embodiment, the pressurizing roller 44 is urged against a heater portion constituted by the heater 43, the plastic supporter 42 and the metallic stay with the endless film 47 interposed therebetween. The heater 43 and the pressurizing roller 44 cooperate with each other to form a nip for nipping and conveying the recording paper.

Figure 3:
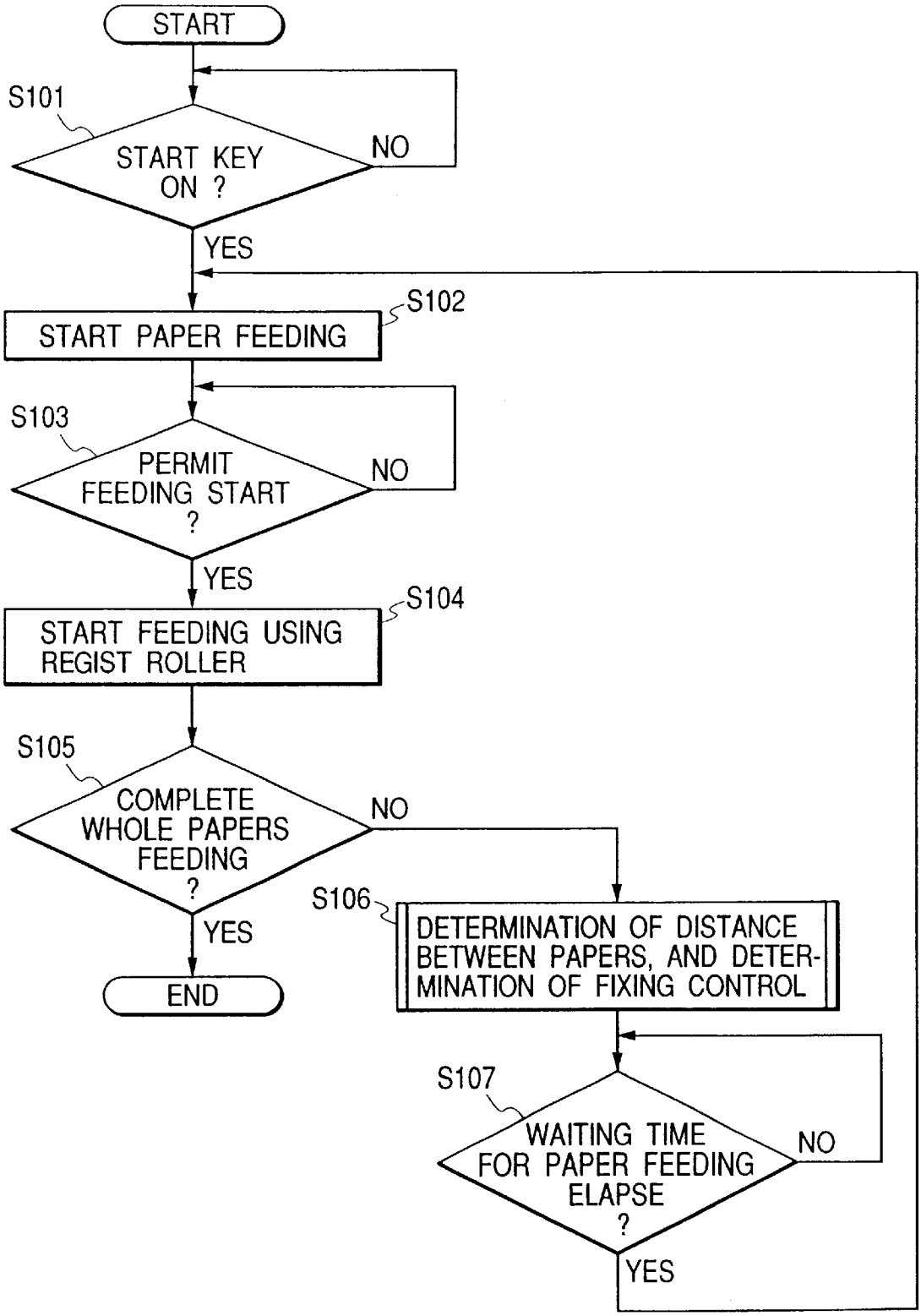
FIG. 3 is a flow chart for illustrating the recording material conveying operation in conveying means according to an embodiment of the present invention.

The recording paper feeding and conveying operation of the conveying unit 20 in the image forming apparatus of the above-described construction will now be described with reference to the flow chart of FIG. 3.

In such an image forming apparatus, when the copy start key 56 is depressed (step 101), the feeding of the recording paper is started from the cassette 23 or the multi-manual feeding portion 24 selected on the operating panel (step 102). As described above, the fed recording paper is once stopped after it has arrived at the registration rollers 19, and the start of the conveyance of the recording paper by the registration rollers 19 is permitted at predetermined timing synchronized with the exposure lamp unit 4-11 (step 103), and the above-described image forming operation (image formation, fixing and paper discharge conveyance) is started (step 104). Here, when all sheets of recording paper set in the operating panel have been fed, the conveying unit 20 completes the feeding of all sheets (step 105). When all sheets of recording paper have not yet been fed, the determination of the distance between sheets of recording paper and the determination of fixing intermittent control which will be described later are effected (step 106), whereafter after a waiting time T for paper feeding determined by the determination of the distance between sheets of recording paper has elapsed (step 107), return is made to the step 102, where the conveying unit 20 starts the feeding of the next recording paper.

Here, the determination of the distance between sheets of paper and the determination of fixing intermittent control (the step 106 of FIG. 3) will be described.

In the embodiment of the present invention, when it is judged that the temperature of the non-paper passing portion of the heater has excessively risen, the control of reducing the number of output sheets per unit time from A sheets to B sheets (A>B) is effected. Accordingly, the apparatus usually operates at a copying speed A, and has, for example, the copying speed changing function of "using a copying speed B after a predetermined number of sheets have been discharged during the formation of a series of images".

Here, description will be made of the distance between recording sheets when the copying speed is X (sheets/min.).

For example, when the length of recording paper of A4 size is L1 (mm), the conveying speed of the recording paper from the paper feeding roller 17 to the registration rollers 19 is V (mm/sec.), and the conveying distance from the paper feeding roller 17 to the registration rollers 19 is M (mm), the aforementioned paper feeding waiting time T (X) (sec.) from the start of the conveyance by the registration rollers 19 till the start of the conveyance of the next recording paper by the registration rollers is calculated by $$T(X)=(60/X)-(M/V(\text{sec.}).$$

Also, the distance between recording sheets (the distance from the trailing end of the preceding recording sheet in the conveying direction to the leading end of the succeeding recording sheet in the conveying direction when a plurality of recording sheets are continuously fixed) N (mm) at this time is calculated as follows:

$$N(X, L1)=V\times(60/X)-L1(\text{mm})$$

In the present embodiment, between the distance N (B, L2) between recording sheets when the copying speed is B (A>B) for the length L2 of any recording sheet and the execution determination standard L of the fixing intermittent control (second control in which the heater is not temperature-controlled and electric power is not supplied to the heater when no recording sheet is nipped by the nip during a plurality of recording sheets are continuously being heated), the relation that $$L<N(B, L2)$$

is established in advance. That is, when the number of output sheets per unit time is B, the fixing intermittent control is effected without fail irrespective of the length of the recording material. Thus, the propriety of the fixing intermittent control is determined by the copying speed.

Also, as described above, the embodiment of the present invention has the function of measuring the length of the recording paper by the registration presensor 91. The distance between recording sheets when the measured length of the recording paper is L3 and the copying speed is A is calculated by $$N(A, L3)=V\times(60/A)-L3,$$

and this is compared with the execution determination standard L of the fixing intermittent control to thereby determine the propriety of the fixing intermittent control. That is, in the case of a printing mode in which the number of output sheets per unit time is A, "the control in which temperature is controlled between sheets (first control) or the control in which temperature is not controlled and electrical energization is stopped (second control)" is selected in conformity with the length of the recording material.

Figure 4:
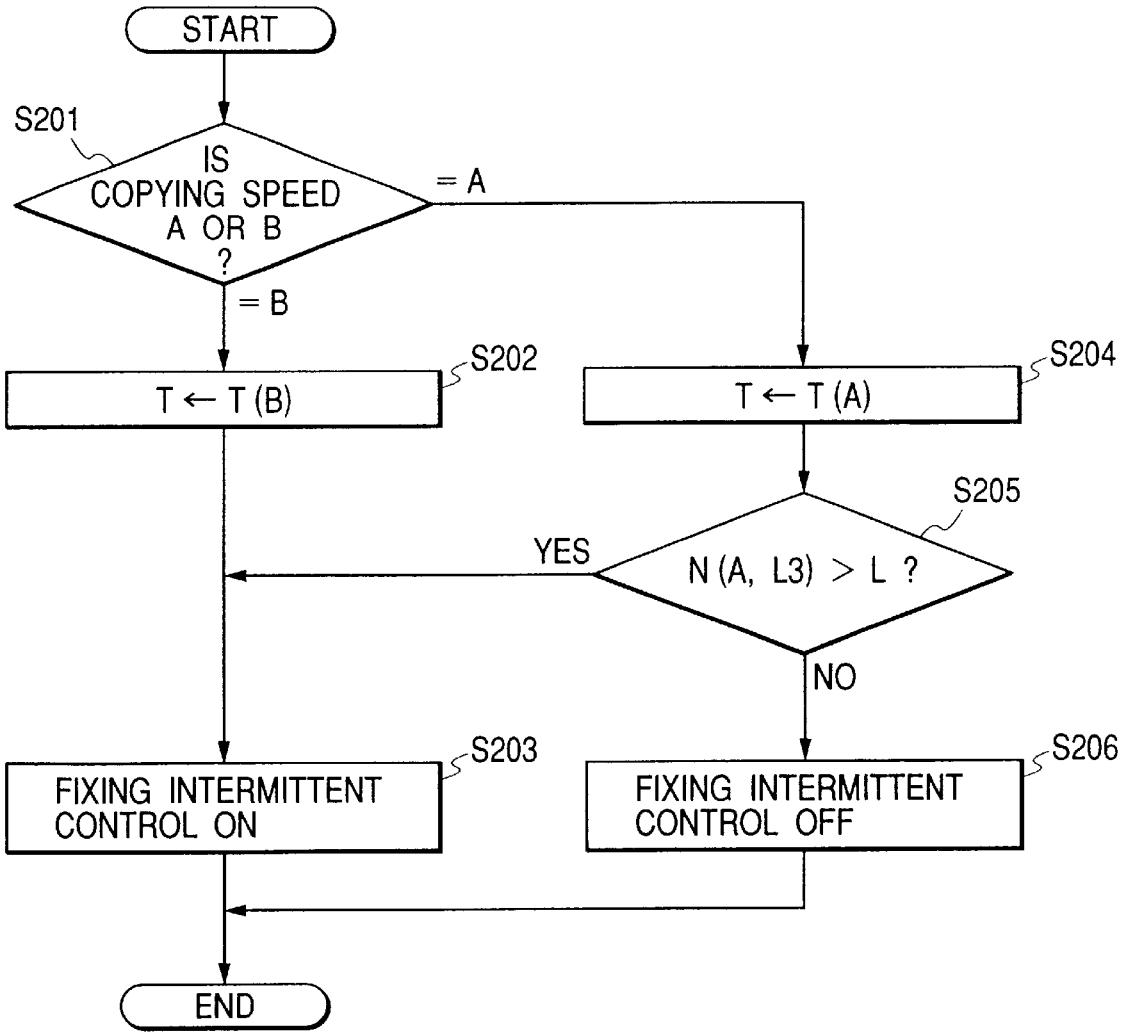
FIG. 4 is a flow chart for illustrating the operation of determining the distance between fixed sheets and the distance between recording sheets in electric power supply control means according to an embodiment of the present invention.

The operation of determining the distance between recording sheets and determining the fixing intermittent control on the basis of the foregoing will now be described with reference to the flow chart of FIG. 4.

In such an image forming apparatus, the controller portion 80 first determines by the conditions of the apparatus (in the case of the present embodiment, the temperature of the non-paper passing portion of the heater) whether the copying speed should be changed from A to B (step 201). When the copying speed is B, T(B) is set as the paper feeding waiting time T (see FIG. 3) (step 202) and the requirement for the fixing intermittent control is put on (step 203). When the copying speed is A, T(A) is set as the paper feeding waiting time T (see FIG. 3) (step 204), whereafter the distance between recording sheets is determined (step 205), and when the distance N (A, L3) between recording sheets calculated from the measured length L3 of the recording paper is greater than the execution determination standard L of the fixing intermittent control, the requirement for the fixing intermittent control is put on (step 203), and when the distance N (A, L3) is smaller than the execution determination standard L of the fixing intermittent control, the requirement for the fixing intermittent control is put off (step 206).

Figure 5:
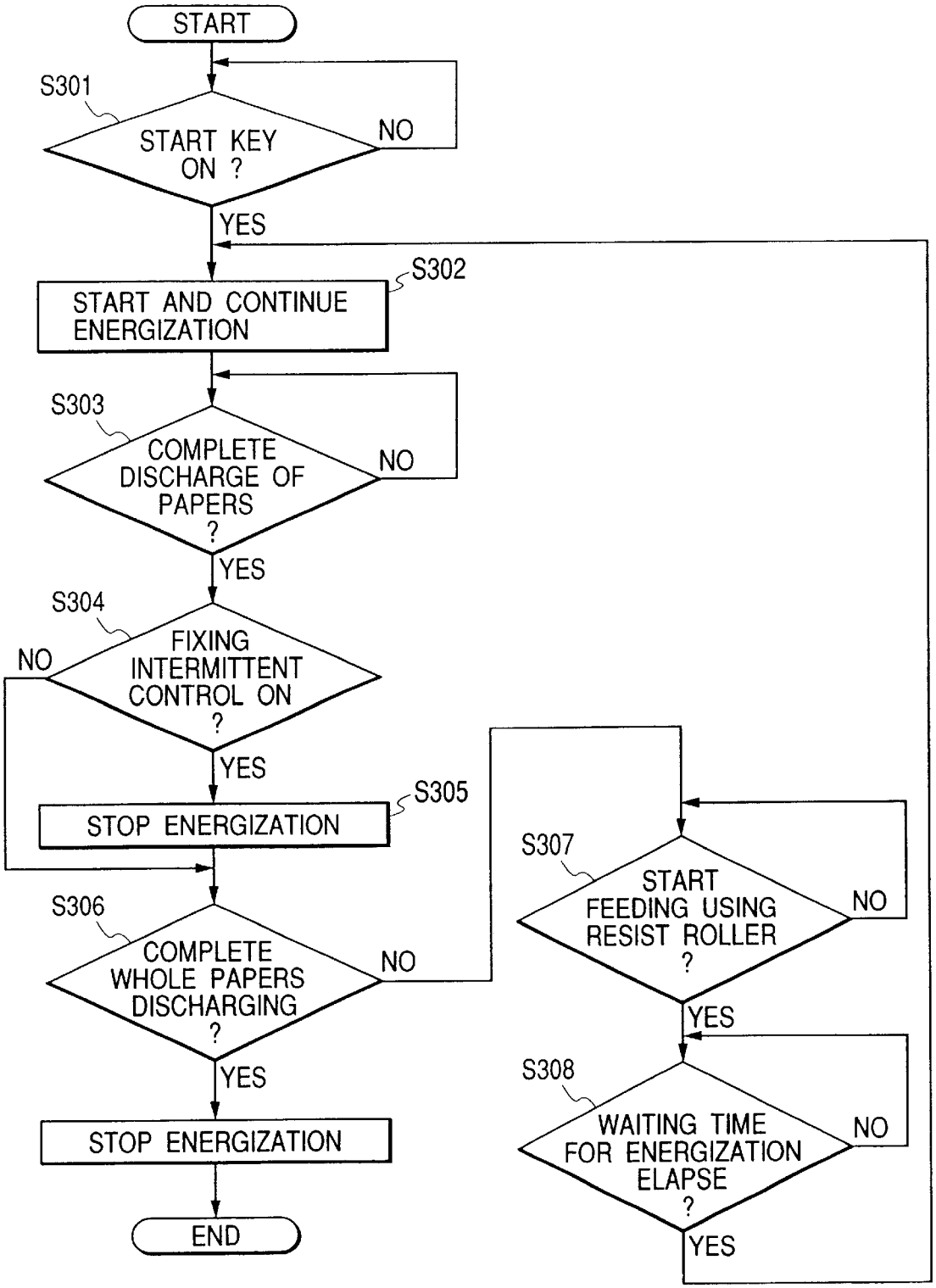
FIG. 5 is a flow chart for illustrating the electric power supply control of a heating member in the electric power supply control means according to the embodiment of the present invention.

The control of the energization to the heater 43 by the controller portion 80 when the recording paper is fed and conveyed while the determination of the distance between recording sheets and the determination of the fixing intermittent control are effected as described above will now be described with reference to the flow chart of FIG. 5.

In such an image forming apparatus, when the start key 56 is first depressed (step 301), the energization to the heater 43 is started (step 302). The heater 43 is always temperature-controlled during being energized so that the temperature of the heater 43 may be a certain target temperature (set temperature). Thereafter, when in the paper discharge sensor 34, it is detected that the recording paper has been discharged (step 303), the energization to the heater 43 is stopped if the aforementioned requirement for the fixing intermittent control is put on (step 304 and step 305). If the requirement for the fixing intermittent control is put off, the energization (temperature control) to the heater 43 is continued. Here, when all sheets of recording paper set in the operating panel have been discharged, the control of the energization to the heater 43 is terminated (step 306). When all sheets of recording paper have not yet been discharged, the start of the conveyance of the succeeding recording paper by the registration rollers 19 is waited for, and when the registration rollers 19 start the conveyance of the succeeding recording paper (step 307), after a predetermined time T2 has elapsed (step 308), return is made to the step 302, where the energization to the heater 43 for fixing the succeeding recording paper is started. If at the step S304, the requirement for the fixing intermittent control was OFF, the heater 43 is continuously energized still after at the step S308, the energization waiting time has elapsed.

The time T2 is a predetermined time from after the recording paper starts to be conveyed by the registration rollers 19 until it is conveyed to the fixing unit 21.

The control of the feeding and conveyance of the recording paper, the determination of the distance between recording sheets, the determination of the fixing intermittent control and the control of the energization to the fixing heater are effected as described above, whereby when the distance between recording sheets is greater than a predetermined distance L, the temperature is not controlled between sheets and it is possible to stop the energization to the fixing heater and prevent the erroneous conveyance of the fixing unit.

The image forming apparatus of the above-described embodiment has a plurality of print modes in which the number of output sheets per unit time differs, but may have a plurality of printing modes in which the moving distance of the recording paper per unit time differs, and in this case, the second control can be effected at the time of a printing mode in which the moving distance per unit time is short.

The present invention is not restricted by the above-described embodiment, but also covers modifications of the same technical idea.

What is claimed is:

1. An image heating apparatus comprising:

a heating member for heating an image on a recording material;

a backup member for forming a nip in cooperation with said heating member; and electric power supply control means for controlling electric power supplied to said heating member so that a temperature of said heating member may be maintained at a set temperature during an image forming operation;

wherein when the recording material is not in the nip as a plurality of recording materials are being continuously heated, said electric power supply control means selects a first control or a second control in conformity with a information on spacing between the recording materials when the plurality of recording materials are being continuously heated, and wherein the first control is such a control that the electric power is supplied so that said heating member is maintained at the set temperature and the second control is such a control that the electric power is not supplied to said heating member regardless of the temperature of said heating member.

2. An image heating apparatus according to claim 1, wherein said electric power supply control means selects the first control when the spacing between the recording materials during the plurality of recording materials are being continuously heated is shorter than a predetermined spacing, and selects the second control when said spacing is longer than the predetermined spacing.

3. An image heating apparatus according to claim 1, which is used in an image forming apparatus having a plurality of printing modes in which the number of output sheets per unit time differs for recording materials of the same size, and wherein said electric power supply control means selects the first control or the second control in conformity with the printing modes.

4. An image heating apparatus according to claim 3, wherein said electric power supply control means selects the second control in the base of the printing mode in which the number of output sheets per unit time is small.

5. An image heating apparatus according to claim 1, which is used in an image forming apparatus having a plurality of printing modes in which the moving distance of the recording material per unit time differs, wherein said electric power supply control means selects the first control or the second control in conformity with the printing modes.

6. An image heating apparatus according to claim 5, wherein said electric power supply control means selects the second control in the case of the printing mode in which the moving distance of the recording material per unit time is short.

7. An image heating apparatus according to claim 1, wherein said electric power supply control means selects the first control or the second control in conformity with the length of the recording material.

8. An image heating apparatus according to claim 7, wherein said electric power supply control means selects the second control when the length of the recording material is shorter than a predetermined length.

9. An image heating apparatus according to claim 1, further comprising film nipped by the nip, and wherein the recording material bearing an image thereon is heated by the heat from said heating member passed through said film.

* * * * *

UNITED STATES PATENT AND TRADEMARK OFFICE

CERTIFICATE OF CORRECTION

PATENT NO. : 6,321,047 B1
DATED : November 20, 2001
INVENTOR(S) : Shinichi Takata It is certified that error appears in the above-identified patent and that said Letters Patent is hereby corrected as shown below:

Column 2,
Line 16, "according" should read -- according to --.

Column 6,
Line 67, "till" should read -- until --.

Column 7,
Line 3, "T(x)=(60/x)-(M/V(sec.)." should read -- T(x)=(60/x)-(M/V) (sec.). --.

Column 9,
Line 5, "a" should be deleted.
Line 17, "during" should read -- while --.

Column 10,
Line 1, "base" should read -- case --.

Signed and Sealed this

Nineteenth Day of March, 2002

*Attest:*

*Attesting Officer*

JAMES E. ROGAN
*Director of the United States Patent and Trademark Office*